United States Patent [19]

Raab

[11] Patent Number: 4,503,431

[45] Date of Patent: Mar. 5, 1985

[54] MULTIPLEX SYSTEM FOR MONITORING ENGINE STATUS

[75] Inventor: Herman P. Raab, Indianapolis, Ind.

[73] Assignee: Consolidated Investments and Development Corp., Carmel, Ind.

[21] Appl. No.: 458,447

[22] Filed: Jul. 17, 1983

Related U.S. Application Data

[63] Continuation-in-part of Ser. No. 191,840, Sep. 29, 1980, abandoned.

[51] Int. Cl.[3] ..... G08C 15/06; G08B 19/00

[52] U.S. Cl. ..... 340/870.13; 340/52 F

[58] Field of Search ..... 340/870.13, 870.14, 340/310 A, 52 R, 52 F; 370/85, 92

[56] References Cited

U.S. PATENT DOCUMENTS

| | | | |
|---|---|---|---|
| 3,866,166 | 2/1975 | Kerscher et al. | 340/870.13 |
| 3,943,488 | 3/1976 | Kazahaya | 340/870.13 |
| 4,037,199 | 7/1977 | Rozehnal et al. | 340/870.13 |
| 4,139,739 | 2/1979 | Shimada et al. | 340/870.13 |
| 4,228,422 | 10/1980 | Perry | 340/310 A |
| 4,272,758 | 6/1981 | Giraud | 340/310 A |

*Primary Examiner*—James J. Groody
*Attorney, Agent, or Firm*—Barnes & Thornburg

[57] ABSTRACT

An engine status telemetry system includes engine parameter sensors, a transmitter, a receiver, and a display mechanism. The transmitter and receiver are time-division multiplexed such that the sensed parameter data is sent in time-serial channels from the transmitter and received and steered by the receiver in parallel format to the display mechanism. The transmitter and receiver are connected by a two-conductor link along which not only the multiplexed data is sent, but also along which the power to operate the receiver and display mechanism is sent. This minimizes the number of conductors which have to be run between the transmitter and receiver, or alternatively, between each of the transmitter and receiver and one or more power supplies. The engine status telemetry system further includes a circuit for determining whether the engine electrical system battery voltage and voltage regulator output voltage are within an acceptable voltage range regardless of whether the system is a 12 VDC or 24 VDC system. This circuit includes a resistor-based voltage-scaling circuit, a zener diode reference voltage circuit, and comparators for comparing the scaled voltages across the resistor-based circuit to the reference voltage across the zener diode circuit and for switching in response to the comparison outcome. The comparator output has a first state when the battery and regulator voltage is within acceptable limits in either the 12 VDC or 24 VDC range and a second state when the sensed voltage is outside the acceptable range. Additional comparator circuitry switches the sensitivity of the resistor-scaling network between the 12 VDC and 24 VDC ranges.

6 Claims, 5 Drawing Figures

DELAY LINE
SHIFT REGISTER
SHIFT REGISTER
90
92
94
320
322
324
326
328
330
332
334
336
338
340
342
344
346
348
350
352
354
356
358
370a
370b
370c
370d
370e
370f
370g
370h
370i
370j
370k
370l
370m
370n
370o
372a
372b
372c
372d
372e
372f
372g
372h
372i
372j
372k
372l
372m
372n
372o
374a
374b
374c
374d
374e
374f
374g
374h
374i
374j
374k
374l
374m
374n
374o
376
378
380
382
384
386
388
390
392
394
396
398
400
402
404
406

MULTIPLEX SYSTEM FOR MONITORING ENGINE STATUS

This application is a continuation-in-part of my copending application Ser. No. 191,840, filed Sept. 29, 1980 now abandoned.

This invention relates to data transmission systems, and more specifically, to a prime mover parameter status telemetry system.

Time-division multiplex telemetry systems are known. There are, for example, the systems of U.S. Pat. Nos. 4,121,055; 3,952,298; and 4,088,980. Time-division multiplex techniques have been used to transmit data relative to conditions typically encountered in prime mover (e.g., engine) parameter sensing. For example, U.S. Pat. No. 4,118,688 discloses a multiplexing technique for transmitting over-voltage/under-voltage conditions. Other disclosures of interest are contained in the following U.S. Pat. Nos. 4,156,232; 3,877,001; 3,311,907; 4,119,904; and 3,997,831.

The present invention offers an improvement over existing multiplex telemetry systems of the general type disclosed in those of the above-identified patents which deal with multiplex telemetry. According to the invention, a multiplex telemetry system includes means for collecting data to be telemetered in time-division multiplex channels, a time-division multiplex transmitter, means for coupling the data-collection means to the transmitter, a time-division multiplex receiver, means for coupling the transmitter to the receiver, a utilization mechanism for the collected and telemetered data, and means for coupling the receiver to the utilization mechanism.

According to the invention, the transmitter includes means for sustaining a non-zero direct current voltage across the transmitter-receiver coupling means between data transmissions to transmit power to the receiver and utilization mechanism, and means for providing zero-going data voltage signals across the transmitter-receiver coupling means during data transmissions. As used herein, "zero-going" is not intended to be limited only to those signals which actually reach zero volts in amplitude, but is also intended to encompass all signals which decrease in absolute magnitude from the power transmission DC voltage level toward zero volts.

Additionally, according to the invention, the means for coupling the transmitter to the receiver consists essentially of two conductors, thereby simplifying the system, in that additional conductors or power supplies need not be provided to ensure the supply of power to both the transmit and receive ends of the telemetry system.

According to another aspect of the invention, a system is provided for determining whether a direct current voltage across a pair of terminals is within either of two acceptable absolute magnitude ranges, one a higher absolute magnitude range, and the other a lower absolute magnitude range. The two absolute magnitude ranges do not overlap. The system also determines whether the voltage across the pair of terminals is in a "forbidden" range which lies outside the two acceptable ranges. The system comprises means for establishing a reference direct current voltage which is lower than the lower limit of the low magnitude range. The system further includes resistive networks for scaling the voltage across the terminals to provide two voltages, the first of which is equal to the reference voltage when the voltage across the pair of terminals is at the high magnitude end of the low magnitude range. The second of the two voltages provided by the resistive networks is equal to the reference voltage when the voltage across the pair of terminals is at the low magnitude end of the low magnitude range. The system further includes a comparison and switching means having a first state when one of the two scaled voltages has a magnitude less than the magnitude of the reference voltage, and the other of the two scaled voltages has a magnitude greater than the magnitude of the reference voltage. The comparison and switching means has a second state when the magnitudes of the two scaled voltages lie both above, or both below, the magnitude of the reference voltage. The second state comprises a warning state wherein the voltage across the pair of terminals lies outside the lower range of acceptable voltages. In order to accept the voltage across the pair of terminals in the higher magnitude voltage range, second comparison and switching means is provided which compares a scaled value of the voltage across the pair of terminals to the reference voltage. The second comparison and switching means has a first state when the voltage across the pair of terminals is less in absolute magnitude than the median value of the two voltage ranges, and a second state when the voltage across the pair of terminals is greater in absolute magnitude than the median value of the two voltage ranges. In the second state, the second comparison and switching means effectively connects load resistors to the two resistive networks such that the two scaled voltages are further reduced in absolute magnitude, and the first of the scaled voltages is equal to the reference voltage when the voltage across the terminals is at the high magnitude end of the higher magnitude range, and the second of the scaled voltages is equal to the reference voltage when the voltage across the terminals is at the low magnitude end of the high magnitude range.

The invention may best be understood by referring to the following detailed description and accompanying drawings which illustrate the invention. In the drawings.

TRANSMITTER

Figure 1:
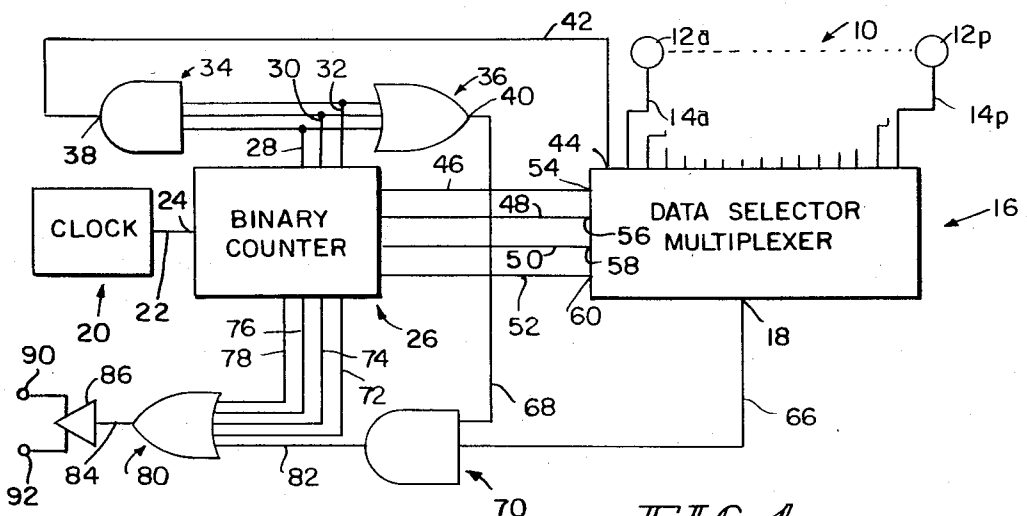
FIG. 1 is a simplified block diagram of a multiplex transmitter constructed according to the present invention.

Referring now generally to FIG. 1, the transmitter 10 is provided to transmit data collected from a plurality of sensors (illustratively sixteen) 12*a*–12*p*, only two of which are shown in FIG. 1. The data collected by the sensors 12*a*–12*p* are various operating parameters of, for example, a diesel engine. The sensors 12*a*–12*p are coupled through lines 14a*–14*p*, respectively, to a data selector multiplexer 16. The data selector multiplexer 16 must, of course, be capable of handling the sixteen parallel channels 14*a*–14*p*. In order to time-division multiplex the sixteen channels onto the single output line 18 of data selector multiplexer 16, an interrogate system including a clock 20 is coupled by a line 22 to a clock input 24 of a binary counter 26. Illustratively, the clock has a period of 0.45 milliseconds. The binary counter is an eleven-stage counter, which permits it to count 2048 clock pulses before resetting. The clock 20 output signal duty cycle is not important, since the clock input 24 of binary counter 26 converts the duty cycle to 50%. The $2^0$ to $2^1$ and $2^2$ (1, 2, and 4, respectively) stage outputs of counter 26 are coupled through lines 28, 30, and 32, respectively, to three inputs of an AND gate 34, and to three inputs of an OR gate 36. The output terminal 38 of AND gate 34 is thus high only on the "seven" count of counter 26. The output terminal 40 of OR gate 36 is low only on the "zero" count of counter 26. Output terminal 38 is coupled through a line 42 to the "override strobe" input terminal 44 of multiplexer 16. The $2^3$, $2^4$, $2^5$, and $2^6$ stage outputs of counter 26 are coupled through lines 46, 48, 50, and 52, respectively, to the four-bit address input terminals 54, 56, 58, 60, respectively, of multiplexer 16. The output terminal 18 of multiplexer 16 and the output terminal 40 of OR gate 36 are coupled through lines 66, 68, respectively, to two input terminals of an AND gate 70.

The $2^7$, $2^8$, $2^9$, and $2^{10}$ output stages of counter 26 are coupled through lines 72, 74, 76, and 78, respectively, to four input terminals of an OR gate 80. The output terminal of AND gate 70 is coupled through a line 82 to another input terminal of OR gate 80. The output terminal of OR gate 80 is coupled by a line 84 through a data link driver 86, illustrated in FIG. 2, to the two-conductor data link conductors 90, 92, illustrated in FIGS. 2–3.

TRANSMITTER OPERATION

In operation, as the clock 20 produces pulses and the counter 26 counts these pulses, the multiplexer 16 is stepped through a sequence that produces at the output terminal 18 of multiplexer 16 a sequence of data which is inverted from the data appearing on the input lines 14*a*–14*p* to multiplexer 16. The data at terminal 18 is passed through AND gate 70 whenever OR gate 36 has a logic "1" condition on its output terminal 40. The multiplexed data is thus passed through OR gate 80 between the $2^0$ (1) and $2^7$ (128) counts of counter 26. Beginning with count 128 of counter 26, the output terminal of OR gate 80, and line 84, drives the line driver 86 to a logic "1" condition for the remaining counts (from $2^7$ through $2^{11}$, or 2,048) of counter 26. Thus, during this interval, power is transmitted on conductors 90, 92 from the transmitter 10 end of the telemetry system to the multiplex receiver 94 (FIG. 3) end of the system. This power is stored in capacitor 328 and is used to drive the multiplex receiver 94 and associated components during the $2^0$–$2^7$ time-division multiplex data transmission time interval.

Figure 4:
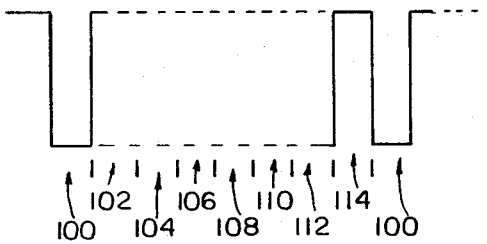
FIGS. 4–5 are diagrams of illustrative time-base wave forms obtained from the data link between the transmitter of FIGS. 1–2 and the receiver of FIG. 3.
Figure 5:
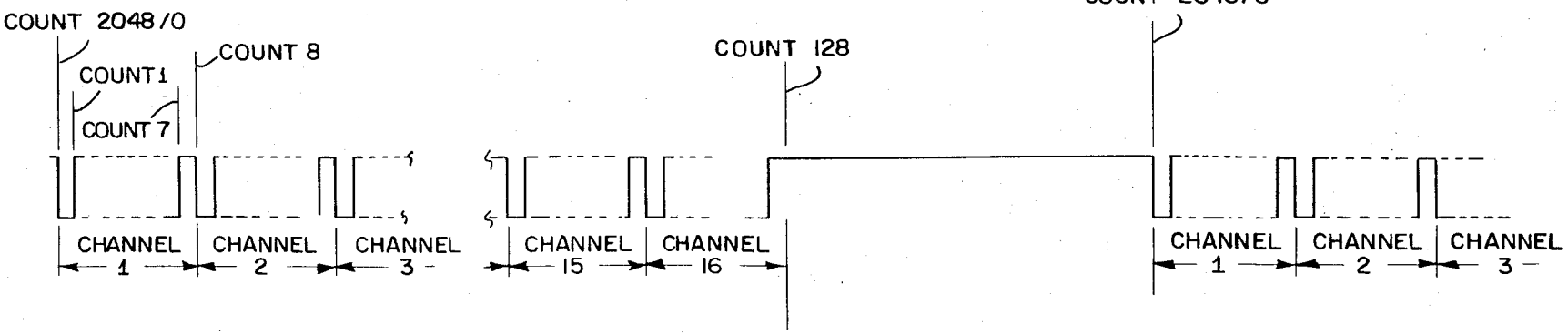

Turning briefly to FIGS. 4–5, the wave form appearing across conductors 90, 92 (FIGS. 2–3) is illustrated. In FIG. 4, the wave form for a single channel illustrates that each channel of information is comprised of eight segments, or bits, 100, 102, 104, 106, 108, 110, 112, and 114. The first segment 100 of these is a synchronizing segment. The next six segments 102, 104, 106, 108, 110, and 112 are the data segments, and will be high (data "0") or low (data "1"). The last segment 114 is a nominalizing segment. Each of the sixteen data channels is produced serially at the output terminal 18 of multiplexer 16 (FIG. 1) during the first 128 counts of the clock 20. This is best illustrated in FIG. 5. As also illustrated in FIG. 5, during all of the remaining counts of counter 26 before it recycles, conductors 90, 92 (FIGS. 2–3) remain at logic "1" to transmit power to the multiplex receiver 94 (FIG. 3).

TRANSMITTER CIRCUITRY

Figure 2:
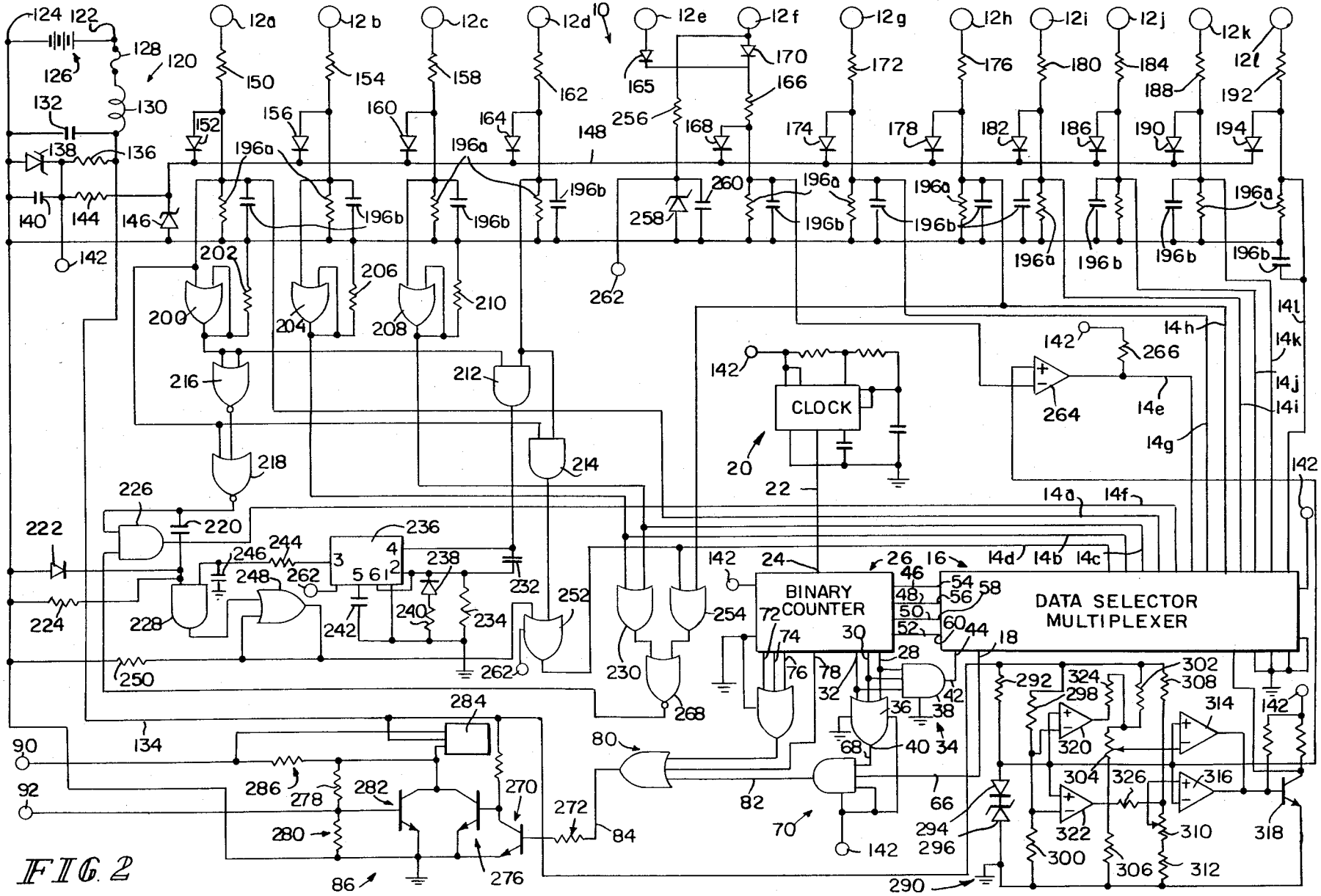
FIG. 2 is a more detailed schematic diagram of the multiplex transmitter of FIG. 1.
Figure 3:
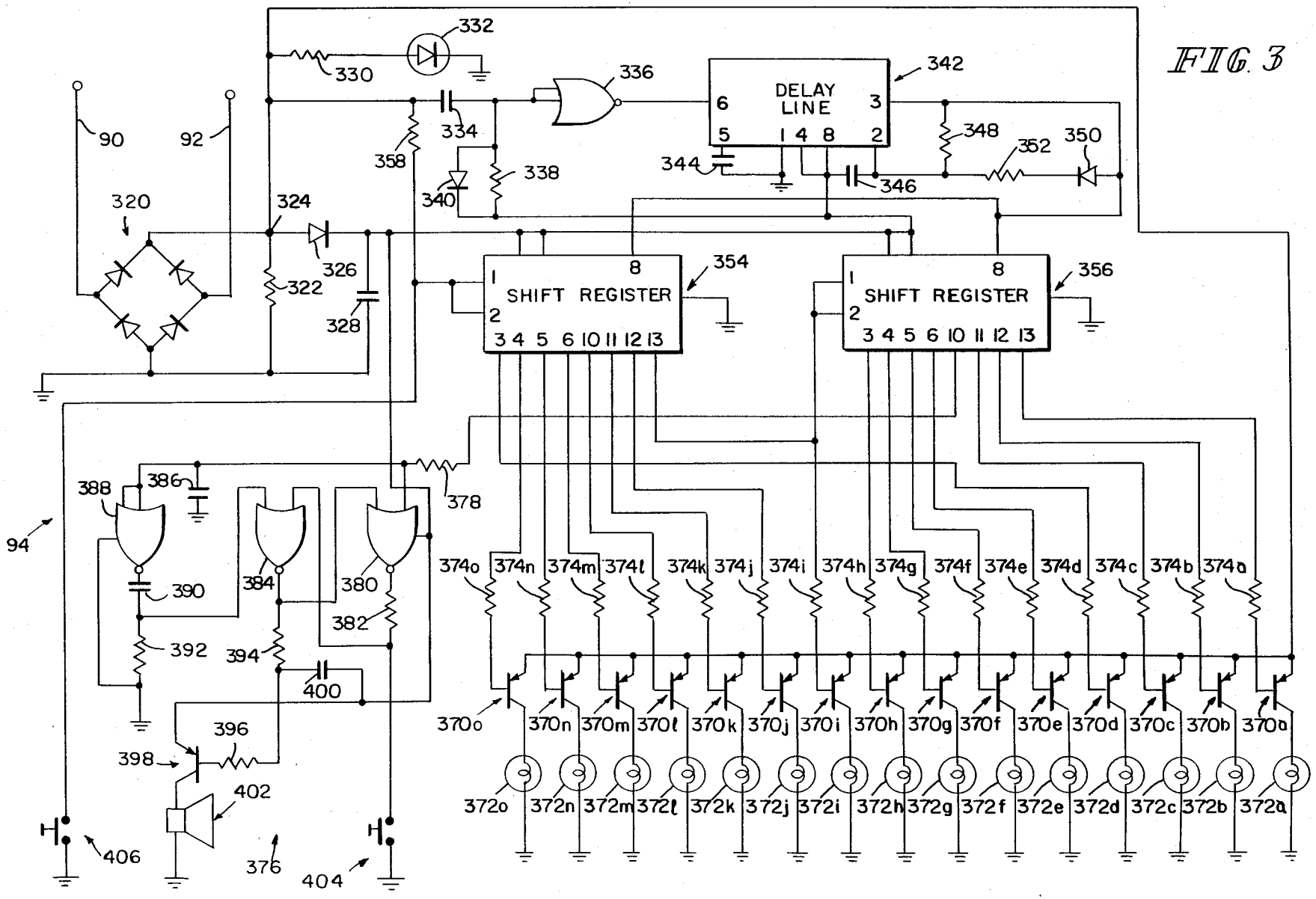
FIG. 3 is a detailed schematic diagram of a multiplex receiver for operation with a multiplex transmitter illustrated in FIGS. 1–2.

Turning now particularly to FIG. 2, a system power supply 120 is coupled between the positive terminal 122 and the ground 124 of an engine battery 126. Supply 120 includes a fuse 128 and a filter including an inductor 130 and a capacitor 132 in series. Line driver potential for the line driver 86 is supplied from the junction of inductor 130 and capacitor 132 through conductor 134 to the line driver 86. This junction is also coupled through a resistor 136 and a reverse-biased zener diode 138 to ground. A capacitor 140 is coupled in parallel with the reverse-biased zener diode 138. The voltage at the cathode of zener diode 138 is the multiplex voltage which is provided at the multiplex voltage supply terminal 142 of the system.

A resistor 144 and a reverse-biased zener diode 146 are coupled between terminal 142 and ground. A conductor 148 extends from the junction of resistor 144 and zener diode 146 to provide a clamping bus for the signals supplied by all of the sensors 12*a*–12*l*. Illustratively, the sensors include a "start" sensor 12*a*, which is coupled to conductor 148 through a current-limiting resistor 150 and a diode 152; an "overspeed" sensor 12*b* which is coupled to conductor 148 through a current-limiting resistor 154 and a diode 156; an "overtemperature" sensor 12*c* which is coupled to conductor 148 through a current-limiting resistor 158 and a diode 160; a "low oil pressure" sensor 12*d* which is coupled to conductor 148 through a current-limiting resistor 162 and a diode 164; a "remote control" sensor 12*e* which is coupled to conductor 148 through a diode 165, a current-limiting resistor 166, and a diode 168; a "manual control" sensor 12*f* which is coupled to conductor 148 through a diode 170, resistor 166, and diode 168; an "alarm" sensor 12*g* which is coupled to conductor 148 through a current-limiting resistor 172 and a diode 174; an "overcrank, or engine failed to start, sensor" 12*h* which is coupled to conductor 148 through a current-limiting resistor 176 and a diode 178; a "low-temperature" sensor 12*i* which is coupled to conductor 148 through a current-limiting resistor 180 and a diode 182; a "high-temperature" sensor 12*j* which is coupled to conductor 148 through a current-limiting resistor 184 and a diode 186; a "low oil pressure" sensor 12*k* which is coupled to conductor 148 through a current-limiting resistor 188 and a diode 190; and a "low-fuel" sensor 121 which is coupled to conductor 148 through a current-limiting resistor 192 and a diode 194. Diodes 152, 156, 160, 164, 168, 174, 178, 182, 186, 190, and 194 clamp circuitry coupled to their anodes at the zener voltage of zener diode 146 plus the forward bias voltages of the respective diodes. A buffer circuit comprising a parallel resistor 196*a* and capacitor 196*b* is coupled between the anode of each of diodes 152, 156, 160, 164, 168, 174, 178, 182, 186, 190, and 194 and ground.

SENSOR SIGNAL CONDITIONING CIRCUITRY

The conditioning circuitry for the signals from each of the sensors 12*a*–12*l* differs slightly, since the output signals from the various sensors are slightly different and require slightly different processing. The output signal from start sensor 12*a* at the anode of diode 152 is coupled to an input terminal of an OR gate 200, the output terminal of which is coupled to another input terminal thereof, and to ground through a resistor 202.

The anode of diode 152 is also coupled directly to line 14*a*. The anode of diode 156 is coupled to an input terminal of an OR gate 204, the output terminal of which is coupled to another input terminal thereof, and to ground through a resistor 206. The output terminal of OR gate 204 is also coupled to line 14*b*. The anode of diode 160 is coupled to an input terminal of an OR gate 208, the output terminal of which is coupled to another input terminal thereof, and to ground through a resistor 210. The output terminal of OR gate 208 is also coupled directly to line 14*c*. The anode of diode 164 is coupled to an input terminal of an AND gate 212, and to an input terminal of an AND gate 214. The other input terminal of AND gate 212 is coupled to the output terminal of OR gate 200. The other input terminal of AND gate 214 is coupled to the input terminal of OR gate 200.

The output terminal of OR gate 200 is also coupled to both input terminals of a NOR gate 216. The output terminal of NOR gate 216 is coupled to one input terminal of a NOR gate 218, the other input terminal of which is coupled to the anode of diode 152. The output terminal of NOR gate 218 is coupled through a capacitor 220 to the cathode of a diode 222, the anode of which is coupled to ground. A resistor 224 is coupled in parallel with diode 222. The output terminal of NOR gate 218 is also coupled to an input terminal of an AND gate 226. The output terminal of AND gate 226 is directly coupled to line 14*f*. The cathode of diode 222 is coupled to an input terminal of an AND gate 228.

The output terminals of OR gates 204 and 208 are coupled to the input terminals of an OR gate 230.

The output terminal of AND gate 212 is coupled through the series combination of a capacitor 232 and a resistor 234 to ground. The output terminal of AND gate 212 is also coupled to a terminal, pin 4, of an integrated circuit 236. The junction of capacitor 232 and resistor 234 is coupled to a terminal, pin 2, of integrated circuit 236, and to a terminal, pin 6, thereof. The cathode of a diode 238 is coupled to pin 2. The anode of diode 238 is coupled through a resistor 240 to ground. Pin 1 of integrated circuit 236 is coupled to ground. Pin 5 of integrated circuit 236 is coupled through a capacitor 242 to ground. Pin 3 of integrated circuit 236 is coupled through a resistor 244 and a capacitor 246 to ground. The junction of resistor 244 and capacitor 246 is coupled to the remaining input terminal of AND gate 228.

The output terminal of AND gate 228 is coupled to an input terminal of an OR gate 248. The output terminal of OR gate 248 is coupled to the other input terminal thereof and to ground through a resistor 250. The output terminal of OR gate 248 is coupled to an input terminal of an OR gate 252. The other input terminal of OR gate 252 is coupled to the output terminal of AND gate 214. The output terminal of OR gate 252 is coupled directly to line 14*d*. Line 14*d* is also coupled to an input terminal of an OR gate 254.

The anode of diode 170, which is coupled to the "manual operation" sensor 12*f*, is also coupled through a resistor 256 to the cathode of a zener diode 258, the anode of which is coupled to ground. A capacitor 260 is coupled in parallel with zener diode 258. The cathode of zener diode 258 provides the logic circuitry operating potential at the terminal 262 of the multiplex transmitter circuit 10. The anode of diode 168 is coupled to the inverting (−) input terminal of a comparator 264. The output terminal of comparator 264 is directly coupled to line 14*e*. Line 14*e* is also coupled through a resistor 266 to terminal 142. The anode of diode 174 is coupled directly to line 14*g*. The anode of diode 178 is coupled to line 14*h*. The anode of diode 178 is also coupled to the remaining input terminal of OR gate 254. The anode of diode 182 is coupled to line 14*i*. The anode of diode 186 is coupled to line 14*j*. The anode of diode 190 is coupled to line 14*k*. The anode of diode 194 is coupled to line 141.

The output terminal of OR gate 230 and the output terminal of OR gate 254 are coupled to the two input terminals of a NOR gate 268. The output terminal of NOR gate 268 is coupled to the remaining input terminal of AND gate 226. The output terminal of AND gate 226 is coupled directly to line 14*f*.

TRANSMITTER OUTPUT-LINE DRIVER

The line driver 86 includes a transistor 270, the base of which is coupled through a resistor 272 to the conductor 84 from the output terminal of OR gate 80. The collector of transistor 270 is coupled through a resistor 274 to line 134. The collector of transistor 270 is also direct-coupled to the base of a transistor 276. The emitter of transistor 276 is coupled to ground. Its collector is coupled through the series combination of resistors 278, 280 to ground. The junction of resistors 278, 280 is coupled directly to the base of a transistor 282. The collector of transistor 282 is coupled to the collector of transistor 276. The emitter of transistor 282 is coupled to ground. The joined collectors of transistors 276, 280 are coupled to the adjustment terminal of a line driver adjustable voltage regulator 284. The input terminal of regulator 284 is coupled to line 134. The output terminal of regulator 284 is coupled to line 90. The output terminal of regulator 284 is also coupled through a resistor 286 to its adjustment terminal. The base of transistor 282 is coupled to line 92.

TRANSMITTER VOLTAGE SENSING CIRCUITRY

The illustrated time-division multiplex transmitter circuit 10 further includes a voltage sensing circuit 290. In circuit 290, a series combination of a resistor 292, a diode 294, and a zener diode 296 is coupled between conductor 134 and ground. A series combination of a resistor 298 and a resistor 300 is coupled between conductor 134 and ground. A series combination of a resistor 302, a potentiometer 304, and a resistor 306 is coupled between conductor 134 and ground. Finally, a series combination of a resistor 308, a potentiometer 310, and a resistor 312 is coupled in series between conductor 134 and ground. The series combination of resistor 292, diode 294, and zener diode 296 establishes a reference direct current voltage which is less than the least acceptable voltage limit of the +12 volt operating range. This reference voltage is established at the anode of diode 294. A resistive network 302, 304, 306 and a resistive network 308, 310, 312 are provided to scale down the potential difference across conductor 134 to ground to provide two voltages, one on the wiper of potentiometer 304 and one on the wiper of potentiometer 310. The first of these voltages, on the wiper of potentiometer 304, is equal to the reference voltage when the potential difference across conductor 134 to ground is at the high end of the lower magnitude (+12 V) range. The second of these, the voltage on the wiper of potentiometer 310, is equal to the reference voltage when the potential difference across conductor 134 to ground is at the low end of the low magnitude (+12 V) range. These two voltages, along with the reference voltage at the anode of diode 294, are supplied to input terminals of two comparators 314, 316. The wipers of potentiometers 304, 310, respectively, are set such that the voltage at the inverting (−) input terminal of comparator 314 will equal the reference voltage at the anode of diode 294 when the voltage on conductor 134 is at the high end of the lower magnitude (+12V) range, and the voltage at the non-inverting (+) input terminal of comparator 316 will equal the reference voltage at the anode of diode 294 when the voltage on conductor 134 is at the low end of the low magnitude (+12 V) range. Therefore, when the two scaled-down voltages bracket the reference voltage, the comparator 314, 316 output terminals are both "high." When the voltage on conductor 134 exceeds the high end of the low magnitude (+12 V) range, the output terminal of comparator 314 goes "low." When the voltage on conductor 134 drops below the low end of the low magnitude (+12 V) range, the output terminal of comparator 316 goes "low." Under either of these latter conditions, a transistor 318 becomes non-conductive, providing an alarm indication (a "high" condition) at an input terminal of data selector multiplexer 16.

In order to accept a conductor 134 voltage in the higher magnitude (+24 V) range, additional comparators 320, 322 and load resistors 324, 326 are provided. When the potential on conductor 134 is above the median of the two voltage ranges, the potential at the inverting (−) input terminals of both comparators 320, 322 exceeds the reference voltage at the anode of diode 294 and the non-inverting (+) input terminals of these comparators 320, 322. Under this condition, the output terminals of both of comparators 320, 322 are "low," and resistors 324, 326, respectively, are placed in parallel with resistors 304, 306, and 310, 312. Under this condition, the potentials on the wipers of potentiometers 304, 310 are adjusted downward sufficiently that these potentials lie within the range of values which will control comparators 314, 316. That is, the potentials on the wipers of potentiometers 304, 310 are within the scaled low magnitude (+12 V) range. Under all other conditions, an alarm signal will be sent through transistor 318 to the data selector multiplexer 16.

RECEIVER CIRCUITRY

Turning now to FIG. 3, the multiplex receiver circuit 94 and its associated components will be explained. In FIG. 3, lines 90, 92 are coupled to a bridge rectifier 320, which is a standard four-diode bridge. Although lines 90, 92 are indicated as being coupled to the rectifier 320 in a particular configuration, it is understood that this configuration of rectifier 320 permits coupling of lines 90, 92 to receiver 94 in either orientation. A resistor 322 is coupled across the output terminal 324 and ground of rectifier 320. A diode 326 and capacitor 328, coupled in series, rectify and store the power signal which is transmitted on lines 90, 92. The series combination of a current-limiting resistor 330 and light-emitting diode (LED) 332 is coupled to terminal 324. When the LED 332 is energized, direct current voltage to power the receiver 94 and associated component exists across capacitor 328.

Data from lines 90, 92 is transferred from the output terminal 324 through a capacitor 334 to both input terminals of a NOR gate 336. Power supply capacitor 328 is also coupled to the input terminals of NOR gate 336 through a resistor 338. A diode 340 has its anode coupled to the input terminals of NOR gate 336 and its cathode coupled to the power supply capacitor 328. It must be remembered that the data voltage signals across lines 90, 92 are zero-going. The circuit including NOR gate 336 inverts the zero-going data voltage signals to provide at the output terminal of NOR gate 336 positive-going data pulses. These pulses are supplied to an input terminal, pin 6, of an integrated circuit 342 to which the output terminal of NOR gate 336 is coupled. Pin 1 of integrated circuit 342 is coupled to ground. Pin 5 of integrated circuit 342 is coupled through a capacitor 344 to ground. Pins 4, 8 of integrated circuit 342 are coupled to the power supply capacitor 328. Pin 2 of integrated circuit 342 is coupled through a capacitor 346 to the power supply capacitor 328. Pin 3, the output terminal, of integrated circuit 342 is coupled through a resistor 348 to pin 2 thereof. Pin 3 is also coupled through the series combination of a diode 350 and a resistor 352 to pin 2. In this configuration, integrated circuit 342 acts as a delay line, delaying the arrival of the synchronizing pulses which precede each of the sixteen channels of data at the enabling input terminals, pins 8, of two eight-bit serial shift registers 354, 356. The data and synchronizing pulses are also coupled through a resistor 358 to the input terminals, pins 1, 2, of shift register 354. As the enabling synchronizing pulses coincide at pins 8 of shift registers 354, 356 with the arrival of data at pins 1, 2 of shift register 354, or when it is overflowed, at pins 1, 2 of shift register 356 via pin 13 of shift register 354, the data in each of the sixteen channels is serially shifted through register 354 and register 356 until all of the data is accumulated in these registers. It is apparent that the data in channel 1 (see FIG. 5), which will be that arriving first at pins 1, 2 of shift register 354, will ultimately appear at pin 13 of shift register 356. Similarly, the data in channel 2, that which arrives second at pins 1, 2 of shift register 354 will ultimately appear at pin 12 of shift register 356, and so on. The last data to arrive, that from channel 16, will appear at pin 3 of shift register 354.

UTILIZATION MECHANISM

A group of lamp drivers and lamps are provided to utilize these output signals at pins 3, 4, 5, 6, 10, 11, 12, and 13 of each of shift registers 354, 356. These signals are utilized to provide visual indications of any alarm conditions in any of the parameters affecting engine operation. The utilization means includes a series of lamp driver transistors **370*a*–370*o*, each of which has its emitter coupled to terminal 324, and its collector coupled to one terminal of a respective lamp 372*a*–372*o*. The other terminal of each lamp 372*a*–372*o* is coupled to ground. The base terminals of transistor 370*a*–370*o* are coupled to respective output terminals of shift registers 354, 356 through base resistor 374*a*–374*o*. As the signals at the respective terminals of the shift registers go to logic "0" conditions in response to the shifting into the respective portions of the register, channels of information containing alarm data, their respective transistors 370*a*–370*o* conduct, and respective lamps 372*a*–372*o* are energized to provide flashing visual indications of these alarm conditions sensed by sensors 12*a*–12*l* (FIGS. 1–2**).

Under certain circumstances, it may also be desirable to provide, in addition to or instead of a visual signal, an audible signal that a particular parameter of prime mover operation has reached an alarm limit. Accordingly, an audible alarm circuit 376 has been provided on one of the output terminals, pin 10, of shift register 356 to provide an audible alarm signal for an alarm condition in the channel of information which is shifted into register 356 and placed on pin 10 of shift register 356. Circuit 376 includes an input resistor 378 which is coupled to one input terminal of a NOR gate 380. The output terminal of NOR gate 380 is coupled through resistor 382 to an input terminal of a NOR gate 384. The output terminal of NOR gate 384 is coupled to another input terminal of NOR gate 380. Resistor 378 is also coupled to ground through a capacitor 386, and to both input terminals of a NOR gate 388. The output terminal of NOR gate 388 is coupled to ground through a series combination of a capacitor 390 and a resistor 392. The junction of capacitor 390 and 392 is coupled to the remaining input terminal of NOR gate 384. In this configuration, NOR gate 388 acts as an inverter. NOR gates 380 and 384 and their associated circuitry comprise a flip-flop circuit which is employed as a horn pre-driver. The pre-driver output terminal is the output terminal of NOR gate 384. This terminal is coupled through series resistors 394, 396 to the base electrode of a horn driver transistor 398. The emitter of horn driver transistor 398 is coupled to the receiver power supply capacitor 328. The junction of resistors 394, 396 is coupled through a capacitor 400 to power supply capacitor 328. The collector of transistor 398 is coupled to an input terminal of a horn 402. The other terminal of the horn 402 is coupled to ground.

RECEIVER OPERATION

In operation of the receiver 94, rectifier 320 is designed to permit connection of the conductors 90, 92 from the multiplex transmitter 10 (FIGS. 1–2) without regard to polarity. The output signal from rectifier 320 is provided directly to the indicator circuit including resistor 330 and LED 332 and provided through the isolating diode 326 to filter capacitor 328. Zero-going data pulses appearing across lines 90, 92 are coupled through capacitor 334 to the delay circuit including integrated circuit 342, and through resistor 358 to the serial shift register 354. The data which cascades through shift register 354 to overflow it flows from pin 13 of shift register 354 onto input pins 1, 2 of shift register 356. The delay circuit including integrated circuit 342 provides a delay of approximately the product of the period of clock 20 (FIGS. 1–2), which is illustratively 0.46 milliseconds, times the square root of seven. This specific delay provides for a storage of data in the shift registers 354, 356 with optimum certainty that the data is, in fact, correct, notwithstanding component tolerance variations and the otherwise possible effect of such variations on the data sampling rate.

The reason for the use of the square root of 7 as a multiplier can best be understood with reference to FIG. 4. In FIG. 4, an individual data channel is illustrated as including a sync pulse 100, the trailing edge (positive-going edge) of which can be thought of as point 1. There follow six additional setments, the trailing edge of the last of which (the leading edge of the nominalizing segment 114) can be thought of as point 7. All of the data between points 1 and 7 will be high (date "0") or low (date "1"), that is, "go" or "no-go" with regard to the status of the engine parameter whose data is being transmitted in that channel. The tolerances of the various components in the electrical circuitry of the system illustrated in FIGS. 1–3 is broad, and components in the transmitter can vary in their tolerances in the opposite direction from components in the receiver. Therefore, it is desired to pick a sampling point to determine the level ("0" or "1") in the various channels in such a way as to minimize the likelihood of loss of data from such channels due to variations of the data channel time locations. The geometric mean of the data channel is chosen as the samping or "interrogate" point for each channel. The geometric mean of N given quantities is the Nth root of their product. The geometric mean of the channel is the square root of the product of the beginning and ending points of the channel, points 1 and 7. Thus, the delay is chosen as the square root of 7 times the clock period.

As individual bits of data are shifted across the stages of shift registers 354, 356, the thermal inertia of indicator lamps **372*a*–372*o* is sufficient to prevent lighting of these lamps until the power transmission interval following the data segments of the data wave form (FIGS. 4–5**).

Audible alarm circuit 376 provides an audible alarm when alarm data appears in the stage of shift register 356 which has its output terminal at pin 10 of shift register 356. A horn-kill switch 404 is provided at the junction of resistor 382 and the input terminal of NOR gate 384 to ground the signal appearing here and silence the horn. The switch 404 illustratively is a spring-return, push-to-close switch, so that the possibility of re-energizing the horn upon the occurrence of subsequent alarm data in the next data sequence is not precluded. A switch 406 of similar type is provided as a test switch for lamps **372*a*–372*o* and alarm circuit 376**.

Among the advantages of the illustrative system are the slow data rate and low impedence level. These considerations render the band width of the transmission line 90, 92 inconsequential, even though the transmission line can be very long. Although the data rate is slow, it is fast enough that an error caused by a spurious signal is inconsequential. This is the case because data is updated approximately every second (0.925 second) with the illustrative system.

Power to operate lamps **372*a*–372*o* and horn 402 is transmitted over conductors 90, 92 which are the same conductors which transmit the data. Lamps 372*a*–372*o* flash at the data transmission rate (e.g., every 0.925 seconds) which aids in attracting attention to any visual alarm indications. The thermal inertia of the incandescent lamps prevents extraneous flashing which would otherwise occur during loading of shift registers 354, 356 with data. Component values in the transmitter 10 and receiver 94 are not critical because the multiplexing system utilizes synchronizing signals for each data bit, and the data bits are of sufficient width that the system will tolerate up to approximately 45% error in the clock 20 rate and 45% error in the time delay provided by integrated circuit 342** simultaneously before data is stored erroneously.

The line driver 86 is of a voltage regulator configuration, and a bridge rectifier 320 is used in the receiver 94 so that only two conductors 90, 92 are used for transmission of all sixteen channels of information plus the power to operate the receiver 94 and associated components. Use of this rectifier 320 configuration avoids the need to observe the polarity of conductors 90, 92. Further, no damage is done by shorting of the conductors 90, 92 together.

The flip-flop horn 402 pre-driver configuration is a latching configuration. The latching function is achieved by sending of an alarm signal from pin 10 of flip-flop 356. The latch operation is reversed (unlatch) by the complement of that signal. The latching function may also be overcome by the kill switch 404. However, operation of the kill switch 404 does not override horn 402 functioning in the next data updating interval following a reset signal which is the complement of the horn signal.

Employment of the voltage sensing circuit 290 permits the system to work automatically on either a 12 VDC or 24 VDC system without any adjustment or modification.

Use of an inverted (zero-going) data pulse system permits power to be transmitted to the receiver most of the time.

In addition to the multiplex system, the transmitter 10 incorporates a converter section which steps down signal at battery voltage to a logic voltage level, filters out spikes in this voltage level, and clamps the logic voltage outputs using only one zener diode reference (zener diode 258 for all logic voltage signals). Additionally, logic is incorporated into the transmitter 10 which synthesizes signals not available externally from the engine starter, such as the auto-start function synthesized by the circuitry including OR gates 200, 204, 230, 254, NOR gate 268, and AND gate 226 and their associated circuitry.

| Integrated Circuit | Commercial Type |
|---|---|
| 16 | 74C150 |
| 20 | 555 |
| 26 | 4040 |
| 236 | 555 |
| 284 | LM 317 |
| 342 | 555 |
| 354, 356 | 74C164 |

What is claimed is:

1. A prime mover status data system, comprising a plurality of prime mover status sensors, a transmitter, means for coupling the sensors to the transmitter, a receiver, means for coupling the transmitter to the receiver, a utilization mechanism, and means for coupling the receiver to the utilization mechanism, wherein the transmitter and receiver are time-division multiplex devices such that the sensed data is sent in time-serial data channels from the transmitter and received and steered by the receiver to the utilization mechanism, the transmitter including means for sustaining a non-zero direct current voltage across the transmitter-receiver coupling means between data transmissions to transmit power to the receiver and utilization mechanism and means for providing zero-going data voltages across the transmitter-receiver coupling means during data transmissions, and the means for coupling the transmitter to the receiver consists essentially of two conductors, the receiver including means for sampling the received data at the geometric mean of the data channel.

2. A prime mover status data system, comprising a plurality of prime mover status sensors, a transmitter, means for coupling the sensors to the transmitter, a receiver, means for coupling the transmitter to the receiver, a utilization mechanism, and means for coupling the receiver to the utilization mechansim, the transmitter and receiver being time-division multiplex devices such that the sensed data is sent in time-serial data channels from the transmitter and received and steered by the receiver to the utilization mechanism, the transmitter including means for sustaining a non-zero direct current voltage across the coupling means between data transmissions to transmit power to the receiver and utilization mechanism and means for providing zero-going data voltages across the transmitter-receiver coupling means during data transmissions, the receiver including means for sampling the data from the transmitter at the geometric mean of the data channel.

3. An engine status data system, comprising a plurality of engine parameter sensors, a transmitter, means for coupling the sensors to the transmitter, a receiver, means for coupling the transmitter to the receiver, a utilization mechanism, and means for coupling the receiver to the utilization mechanism, wherein the transmitter and receiver are time-division multiplex devices such that the sensed parameters are sent in time-serial data channels from the transmitter and received and steered by the receiver to the utilization mechanism, the receiver including means for interrogating the data from the the transmitter at the geometric mean of the data channel.

4. The apparatus of claim 3 wherein the transmitter includes means for sustaining a non-zero direct current voltage across the transmitter-receiver coupling means between data transmissions to transmit power to the receiver and utilization mechanism and means for providing zero-going data signal voltages across the transmitter-receiver coupling means during data transmissions.

5. The apparatus of claim 3 wherein the channels are serially scanned and the utilization mechanism updated with the serially scanned information.

6. A status data system adapted to be coupled to a plurality of status data inputs, comprising a transmitter, means for coupling the data inputs to the transmitter, a receiver, means for coupling the transmitter to the receiver, a utilization mechanism, and means for coupling the receiver to the utilization mechanism, wherein the transmitter and receiver are time-division multiplex devices such that the sensed data is sent in time-serial channels from the transmitter and received and steered by the receiver to the utilization mechanism, the transmitter including means for sustaining a non-zero direct current voltage across the transmitter-receiver coupling means between data transmissions to transmit power to the receiver and utilization mechanism and means for providing zero-going data voltages across the transmitter-receiver coupling means during data transmissions, and the means for coupling the transmitter to the receiver consists essentially of two conductors, the receiver including means for interrogating the data from the transmitter at the geometric mean of the data transmission interval.

* * * * *

UNITED STATES PATENT AND TRADEMARK OFFICE

CERTIFICATE OF CORRECTION

PATENT NO. : 4,503,431

DATED : March 5, 1985

INVENTOR(S) : Herman P. Raab

It is certified that error appears in the above-identified patent and that said Letters Patent is hereby corrected as shown below:

On the title page, item [22] Filed: delete "Jul. 17, 1983" and insert --Jan. 17, 1983--therefor;

Signed and Sealed this

*Third* Day of *September 1985*

[SEAL]

*Attest:*

DONALD J. QUIGG

*Attesting Officer* *Acting Commissioner of Patents and Trademarks - Designate*